United States Patent [19]

Goldberg

[11] Patent Number: 4,631,770

[45] Date of Patent: Dec. 30, 1986

[54] HAND TOOL/PROTECTIVE DEVICE

[76] Inventor: Michael L. Goldberg, 1617 Fannin St., Apt. #2909, Houston, Tex. 77002

[21] Appl. No.: 809,298

[22] Filed: Dec. 16, 1985

[51] Int. Cl.[4] ..... B25F 1/02

[52] U.S. Cl. ..... 7/167; 81/490; 70/456 R; 273/84 R

[58] Field of Search ..... 7/165, 167, 170; 81/177.4, 490; 273/84 R; 70/456 R

[56] References Cited

U.S. PATENT DOCUMENTS

| | | | |
|---|---|---|---|
| 19,901 | 4/1858 | Aiken | 81/490 |
| 350,249 | 10/1886 | Holman . | |
| 457,160 | 8/1891 | Killenberger . | |
| 1,541,078 | 6/1925 | Sudweeks | 7/167 |
| 2,635,661 | 4/1953 | Egan | 81/490 |
| 4,007,931 | 2/1977 | Wich et al. | 273/84 R |
| 4,365,808 | 12/1982 | Perez | 273/84 R |
| 4,448,097 | 5/1984 | Rocca . | |
| 4,456,255 | 6/1984 | Braunhut | 273/84 R |
| 4,460,174 | 7/1984 | Perry | 273/84 R |
| 4,475,367 | 10/1984 | Raitto | 70/456 R |
| 4,489,943 | 12/1984 | Werft | 273/84 R |
| 4,506,889 | 3/1985 | Lewis | 273/84 R |

FOREIGN PATENT DOCUMENTS

| | | | |
|---|---|---|---|
| 1055179 | 10/1953 | France | 70/456 R |
| 2024002 | 1/1980 | United Kingdom | 70/456 R |
| 1578372 | 11/1980 | United Kingdom | 81/177.4 |

*Primary Examiner*—Roscoe V. Parker

*Attorney, Agent, or Firm*—Dodge, Bush & Moseley

[57] ABSTRACT

A compact hand-held device adapted for alternative use as a protective weapon, a tool or a key holder is disclosed. A hollow cylindrical member having an open end and a closed end includes a chamber for storing a plurality of tool elements. A removable closure is threadably received in the open end for sealing the chamber of the hollow member. A key ring is secured to the closure for use of the key ring both as a key holder and as a protective weapon. A hexagon opening in the closed end is provided for rigidly removably securing a corresponding shank of one of the tool elements axially outwardly from the closed end when the tool element is in the operating position. A tapered butt is sealingly and threadably secured on the closed end for providing a protective weapon.

14 Claims, 3 Drawing Figures

FIG.1
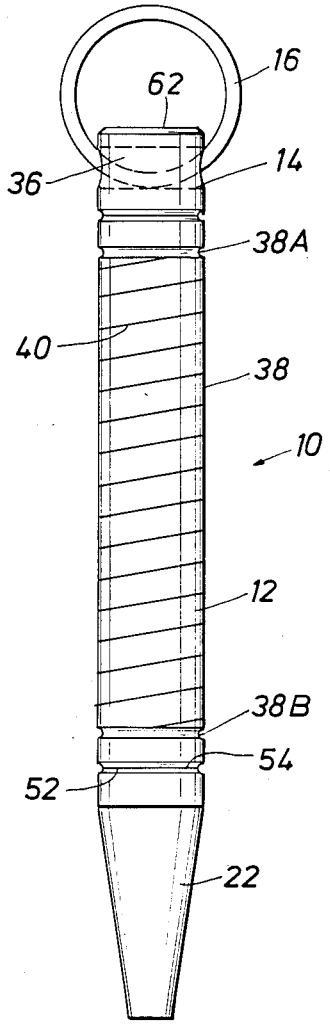
FIG. 2
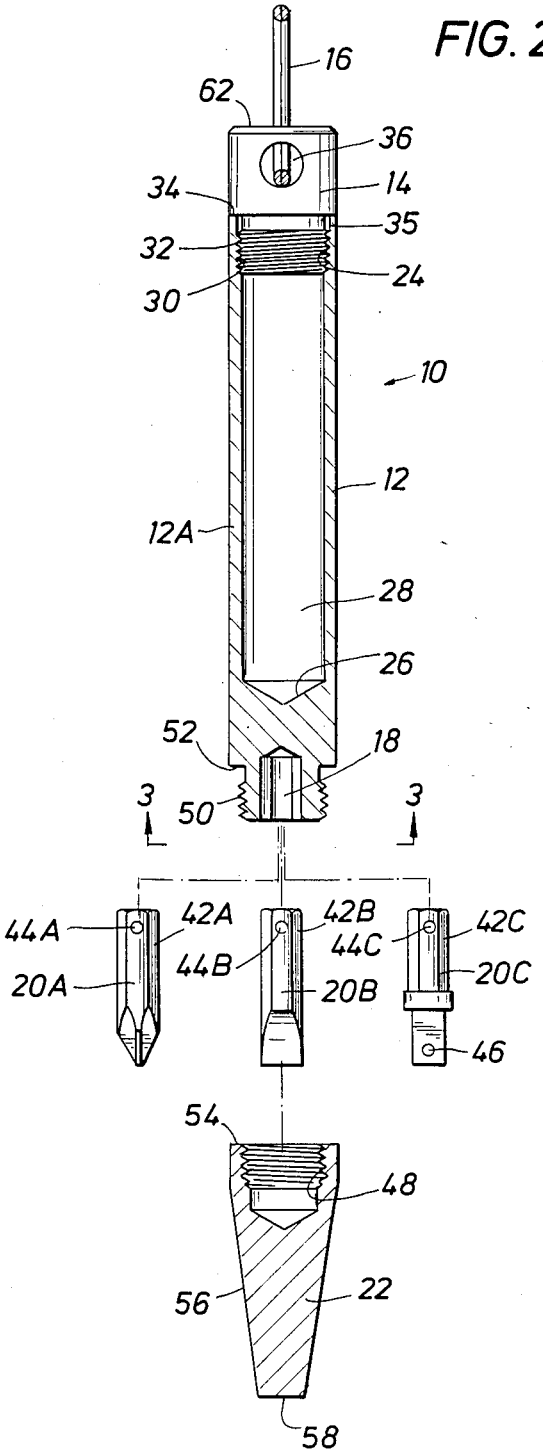
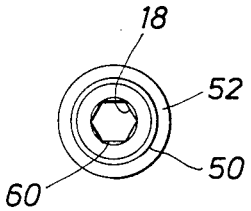
FIG. 3

HAND TOOL/PROTECTIVE DEVICE

BACKGROUND OF THE INVENTION

1. Field of the Invention

This invention relates to the field of a compact hand-held apparatus and, in particular, to a compact hand-held device adapted for alternative use as a protective weapon, a tool or a key holder.

2. Description of the Prior Art

Various types of hand-held protective devices and tools have been developed over the years.

Examples of protective devices are disclosed in U.S. Pat. No. 4,506,889 and U.S. Pat. No. 4,460,174. U.S. Pat. No. 4,506,889 discloses a protective device including an elongated hollow handle having a closed loop member that extends from openings in one end of said handle and is connected to a releasable closure disposed at the other open end of the handle. A key ring is secured to the closure for facilitating removal of the closure from the handle. The housing or handle is disclosed as being made of metal or high impact plastic and is of a generally uniform diameter. U.S. Pat. No. 4,460,174 discloses a self defense weapon having a hollow handle for providing storage for an elongated, flexible cord. The hollow handle member has a removable end cap having a number of keys. The keys are connected to the cap through a key ring carried by an axially movable plunger element that passes through the interior of the handle. The keys which are hurled at an attacker are held in position on the handle by a releasable keeper element.

Examples of tools are disclosed in U.S. Pat. No. 2,635,661 and U.S. Pat. No. 4,448,097. U.S. Pat. No. 2,635,661 discloses a tool having a multiple tool housing handle, a mechanism associated with the handle for selectively moving one of the tools into operating position relative to the handle and means for locking the tool in its operating position. The handle of the tool is hollow to form a housing for the tools each of which has a hexagon shank which when in the operative position registers with a corresponding opening in the lower end of the tool to prevent rotation of the tool relative to the handle.

U.S. Pat. No. 4,448,097 discloses a driver tool using a sleeve which fits within and rotates with an elongated shaft. A multiplicity of bits are held in the sleeve and turned by the action of the rotating shaft. Magnetic means are included for confining the driving bits within the tube. Additionally, an expandable handle is connected to the elongated shaft to provide a gripping means in its expanded form.

A compact hand-held device could be assembled for alternative use as a tool, a key holder or a protective weapon would be desirable. The problem is to provide one compact hand-held device that could provide all these useful items.

Identification of the Objects of the Invention

Therefore, an object of this invention is to provide a compact hand-held apparatus adapted for alternative use as a tool, a protective device and a key holder.

It is another object of this invention to provide a self defense device which can be assembled as a hand tool having a plurality of tool elements whereby the elements are stored in a sealed chamber of the hollow member.

It is another object of the invention to provide a lightweight compact protective device that is harmless looking which can also be used as a hand tool.

SUMMARY OF THE INVENTION

A compact hand-held device adapted for alternative use as a protective weapon, a tool or a key holder is disclosed. A hollow cylindrical member having an open end and a closed end includes a chamber for storing a plurality of tool elements. A removable closure is threadably received in the open end for sealing the chamber of the hollow member. A key ring is secured to the closure means for use both as a key holder and as a protective weapon.

A hexagon opening in the closed end is provided for rigidly securing a corresponding shank of one of the tool elements axially outwardly from the closed end when the tool element is in the operating position. A tapered butt is sealingly and threadably secured on the closed end for providing a protective weapon.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 1 is an elevational view of the compact hand-held apparatus of the present invention with the tool elements in the stored position;

FIG. 2 is an exploded sectional view of the apparatus of the present invention with the tool elements aligned for use in the operating position; and FIG. 3 is a sectional view taken along lines 3—3 of FIG. 2.

DETAILED DESCRIPTION OF THE PREFERRED EMBODIMENT

The apparatus 10 embodying the present invention is shown in detail in FIGS. 1–3. The apparatus includes a hollow member 12, a removable closure 14, a key ring 16, a polygonal opening 18, a plurality of tool elements or bits 20A, 20B and 20C and a tapered butt 22.

The hollow cylindrical member 12 comprises an open end 24 and a closed end 26, as best shown in FIG. 2. The hollow cylindrical member 12 has a chamber 28 for storing a plurality of tool elements 20A, 20B and 20C. The chamber 28 is axially positioned within the cylindrical member 12 so as to provide a uniform thickness in the wall **12*a* of the hollow member 12. The open end 24 of the hollow member 12 has an inwardly threaded surface 30 to receive the outwardly threaded surface 32 of the closure 14**.

The hollow member 12 has an upwardly facing shoulder 34 thereon for engagement with the downwardly facing shoulder 35 of the closure 14 for sealing the chamber 28 of the hollow member 12. The closure 14 has an aperture 36 for receiving a key ring 16, as best shown in FIGS. 1 and 2. The aperture 36 is sized so as to allow movement of the ring 16 relative to the hollow member 12. Additionally, the key ring 16 is of the split-type for removing the ring 16 from the closure 14 and for securing a plurality of keys thereon.

The exterior surface 38 of the hollow member 12 has grooves 38A and 38B disposed adjacent the open end 24 and the closed end 26, respectively. These grooves 38A and 38B aid in the fabrication of the spiral groove 40 extending between the groove 38A and the groove 38B.

The spiral groove 40 provides a gripping means on the exterior surface 38 of the hollow member 12.

The polygonal opening 18 is positioned in the closed end 26 of the hollow member 12 for receiving the corresponding polygonal shanks 42A, 42B and 42C of screwdrivers for a Phillips head screws, plain screwdriver screws and a screw wrench for an Allen head screw, respectively. The securing means or opening 18 axially positions the tool elements 20 outwardly from the closed end 26 when tool element is in the operating position. Additionally, the shanks 42A, 42B and 42C are provided with a ball bearing means 44A, 44B and 44C rotatably disposed therein for providing a pressure-type securement of the shank to the polygonal opening 18. The tool element 20C provides an additional ball bearing 46 disposed therein for adaption of the element with Allen wrenches.

When the plurality of tool elements 20 are stored in the chamber 28, thereby removing all tool elements from opening 18, the tapered butt means 22 having inwardly threaded surface 48 is received on the outwardly threaded surface 50 of the closed end 26. The threads 50 are disposed radially outwardly from the polygonal opening 18. A downwardly facing shoulder 52 on the hollow member 12 sealingly engages the upwardly facing surface 54 of the butt 22 to prevent entry of corrosive elements. This sealing of the closed end prevents entry of foreign fluids or particles from lodging in the opening 18 which would prevent securement of the tool elements 20 in the opening 18.

The butt 22 has a tapered surface 56 thereon which terminates at a blunt surface 58 so that the device is legal for civilian use. The defender is able to punish an attacker with the blunt surface but would not critically puncture the attacker. The protective device is therefore the most humane possible that can realistically protect its user.

FIG. 3 better illustrates the shoulder 52, the threads 50 and the opening 18. Chamfer 60 is provided adjacent the opening 18 to facilitate the securement of the tool elements 20 into the opening 18. FIG. 3 also better illustrates, in combination with FIGS. 1 and 2, the cylindrical form of the apparatus. The apparatus 10 is preferably approximately 5.75 inches (14.59 cm) in length from the blunt surface 58 to the rear surface 62 of the closure 14. The hand-held apparatus provides use of the apparatus as a protective weapon, a tool and a key holder while maintaining it relative compact size.

A plurality of keys secured onto the ring 16 may be used for a slashing motion against the attacker and are securely fixed to the tubular member 12 so that more than one blow can be struck at the attacker. The plurality of keys would have the ability to inflict serious injury to an attacker, particularly to the head area, as the weapon has the advantage of surprise due to its initial appearance as a key holder. On the other hand, the butt end can be used for striking, gouging, nerve pinching and pain compliance holds making it an effective device for close range defense.

The chamber 28 of the hollow member 22 provides a sealed non-corrosive environment for the tool elements 20. The apparatus provides a compact hand-held versatile tool having the performance characteristic of full sized tools in the maintenance, service, and repair of any conceivable item.

A second embodiment could comprise the tip 22 and handle 12 being a solid one piece item and the chamber 28 being used for storage of items such as a ninja throwing nail. The closure means 14 could then be used to seal items in the chamber 28 as shown in FIG. 2.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. Apparatus adapted for alternative use as a protective weapon, a tool or a key holder, said apparatus comprising:

a hollow member having an open end and a closed end, said member having a chamber for storing at least one tool element, a removable closure means received in the open end for sealing said chamber, means for securing keys to said closure means, means for removably securing said tool element axially outwardly from the closed end when said tool element is in an operating position, a butt means securable on the closed end for providing a protective weapon, and means for sealingly securing said butt means on the closed end.

2. The apparatus of claim 1 is fabricated from metal.

3. The apparatus of claim 1, wherein said closure means is threadably secured to said hollow member.

4. The apparatus of claim 1 is approximately 5.75 inches (14.59 cm.) in length.

5. The apparatus of claim 1, wherein said sealed chamber can store a plurality of tool elements.

6. The apparatus of claim 1, further comprising a gripping means on the exterior surface of the hollow member.

7. The apparatus of claim 1, wherein said butt means having a blunt surface on one end and an inwardly threaded surface on the other end.

8. A method for assembling a compact hand-held apparatus adapted for use as a protective weapon or a tool, the method comprising the steps of:

providing a hollow cylindrical member having an open end and a closed end and a removable closure means receivable in the open end for sealing said hollow member, said closure means having a key ring, removably securing a tool element to said closed end when said apparatus is used as a tool, said tool element positionable relative to said member between a stored position within said sealed member and an operating position extending substantially axially outwardly from the closed end of said member, removing said tool element from the closed end and storing it within said member, sealing said open end with the closure means after said tool element is stored therein, sealingly securing a butt means on said closed end when said tool element is in the stored position for use of the apparatus as a protective weapon.

9. A compact hand-held apparatus adapted for alternative use as a protective weapon, a tool or a key holder, said apparatus comprising:

a hollow cylindrical member having an open end and a closed end, said member having a chamber for storing a plurality of tool elements, a removable closure means threadably secured in the open end for sealing said chamber, said closure means having a key ring, a tool element being removably secured to said hollow member, said tool element positionable relative to said member between a stored position within said sealed member and an operating position extending substantially axially outwardly from the closed end of said member, a polygonal opening in the closed end for rigidly securing a corresponding shank of said tool element to the closed end when said tool element is in the operating position, and a tapered butt means sealingly threadably secured on the closed end for providing a protective weapon when said tool element is in the stored position, said threads on the closed end being disposed radially outwardly from said polygonal opening.

10. The apparatus of claim 9 wherein said shank of said tool element having a ball bearing means rotatably disposed therein for providing a pressure-type securement of said shank in the polygonal opening.

11. The apparatus of claim 9 is fabricated from metal.

12. The apparatus of claim 9 is approximately 5.75 inches (14.59 cm.) in length.

13. The apparatus of claim 9, further comprising a gripping means on the exterior surface of the hollow member.

14. The apparatus of claim 9, wherein said butt means having a blunt surface on one end and an inwardly threaded surface on the other end.

* * * * *